US012035742B2

(12) United States Patent
Lavanchy et al.

(10) Patent No.: US 12,035,742 B2
(45) Date of Patent: Jul. 16, 2024

(54) AEROSOL-GENERATING ARTICLE WITH HIGH AEROSOL FORMER CONTENT

(71) Applicant: Philip Morris Products S.A., Neuchatel (CH)

(72) Inventors: Frederic Lavanchy, Chavornay (CH); Marine Jarriault, Bern (CH); Chrystophe Schaller; Celine Lesuffleur, Neuvecelle (FR)

(73) Assignee: Philip Morris Products S.A., Neuchatel (CH)

( * ) Notice: Subject to any disclaimer, the term of this patent is extended or adjusted under 35 U.S.C. 154(b) by 526 days.

(21) Appl. No.: 17/298,835

(22) PCT Filed: Dec. 4, 2019

(86) PCT No.: PCT/EP2019/083706
§ 371 (c)(1),
(2) Date: Jun. 1, 2021

(87) PCT Pub. No.: WO2020/115151
PCT Pub. Date: Jun. 11, 2020

(65) Prior Publication Data

US 2022/0030930 A1 Feb. 3, 2022

(30) Foreign Application Priority Data

Dec. 6, 2018 (EP) ..... 18210856

(51) Int. Cl.

| | |
|---|---|
| ***A24F 40/57*** | (2020.01) |
| ***A24B 15/14*** | (2006.01) |
| ***A24B 15/167*** | (2020.01) |
| ***A24B 15/30*** | (2006.01) |

(Continued)

(52) U.S. Cl.
CPC ..... *A24B 15/167* (2016.11); *A24B 15/14* (2013.01); *A24B 15/30* (2013.01); *A24D 1/18* (2013.01); *A24F 40/46* (2020.01); *A24F 40/57* (2020.01)

(58) Field of Classification Search
CPC ..... A24B 15/167; A24B 15/30; A24B 15/16; A24B 15/14; A24B 15/12; A24B 15/10;
(Continued)

(56) References Cited

U.S. PATENT DOCUMENTS

| | | | |
|---|---|---|---|
| 5,396,911 | A | 3/1995 | Casey, III et al. |
| 2015/0040924 | A1 | 2/2015 | Mironov et al. |

(Continued)

FOREIGN PATENT DOCUMENTS

| | | | |
|---|---|---|---|
| EP | 0 336 457 | A2 | 10/1989 |
| EP | 3 363 305 | A1 | 8/2018 |

(Continued)

OTHER PUBLICATIONS

Korean Office Action issued Jul. 12, 2023 in Korean Patent Application No. 10-2021-7009993 (with English Translation), 18 pages.

(Continued)

*Primary Examiner* — Khiem M Nguyen
(74) *Attorney, Agent, or Firm* — Oblon, McClelland, Maier & Neustadt, L.L.P.

(57) ABSTRACT

An aerosol-generating article is provided, including: a substrate portion containing an aerosol-forming substrate; and a connect portion disposed at one end of the aerosol-generating article in direct abutment with the substrate portion, the connect portion having a tubular empty core structure, the substrate portion having a length of between 20 millimeters and 60 millimeters, and a diameter of between 4 millimeters and 7 millimeters, the aerosol-forming substrate including an aerosol former, and an amount of the aerosol former (Continued)

Figure 1:
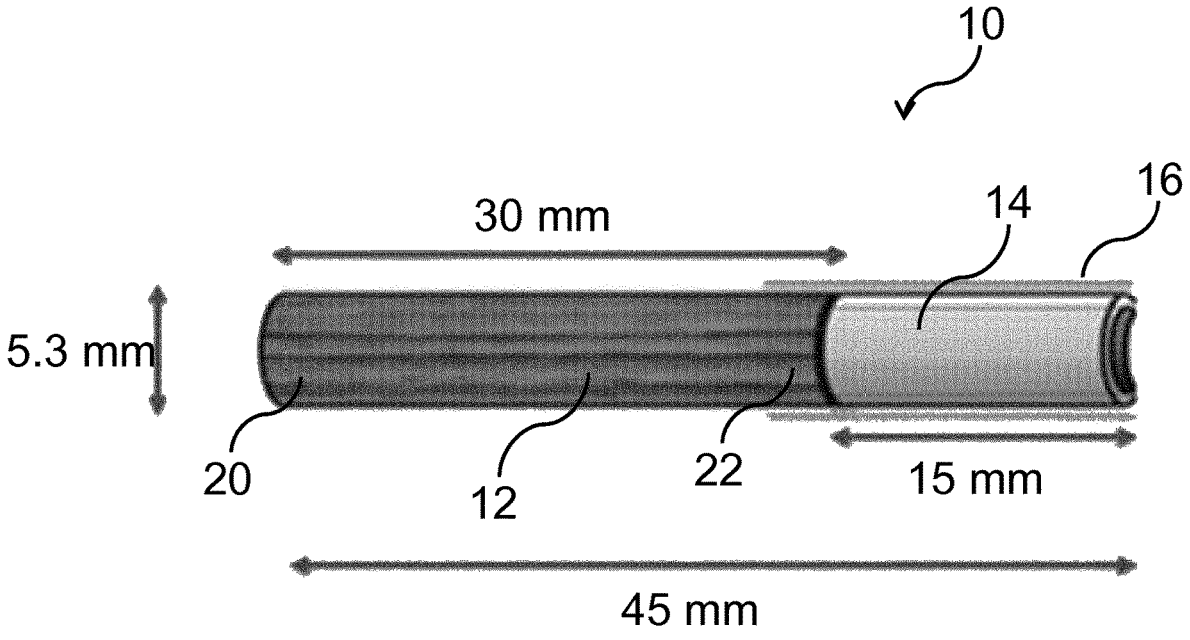

ranges between 6 percent and 20 percent by weight on a dry weight basis of the aerosol-forming substrate. An aerosol-generating system including the aerosol-generating article and an aerosol-generating device, and a method for manufacturing the aerosol-generating article, are also provided.

18 Claims, 3 Drawing Sheets

(51) Int. Cl. *A24D 1/18* (2006.01)
*A24F 40/46* (2020.01)

(58) Field of Classification Search
CPC ..... A24F 40/40; A24F 40/46; A24F 40/57; A24F 40/50; A24D 1/18; A24D 1/00
USPC ..... 131/329
See application file for complete search history.

(56) References Cited

U.S. PATENT DOCUMENTS

| | | | |
|---|---|---|---|
| 2015/0150302 | A1 | 6/2015 | Metrangolo et al. |
| 2017/0035116 | A1 | 2/2017 | Batista |
| 2018/0035708 | A1 | 2/2018 | Kaljura |

FOREIGN PATENT DOCUMENTS

| | | | |
|---|---|---|---|
| JP | 2014-532439 | A | 12/2014 |
| JP | 2015-517817 | A | 6/2015 |
| JP | 2016-195585 | A | 11/2016 |
| JP | 2017-518032 | A | 7/2017 |
| JP | 2017-534266 | A | 11/2017 |
| JP | 2018-509897 | A | 4/2018 |
| KR | 10-1375774 | B1 | 3/2014 |
| RU | 2 673 615 | C1 | 11/2018 |
| WO | WO 2013/178766 | A1 | 12/2013 |
| WO | WO 2016/135503 | A1 | 9/2016 |

OTHER PUBLICATIONS

International Search Report and Written Opinion issued Feb. 27, 2020 in PCT/EP2019/083706 filed Dec. 4, 2019.

Search Report issued Dec. 24, 2021 in corresponding Russian Patent Application No. 2021119562, 2 pages.

Japanese Office Action issued Jun. 22, 2022, in Japanese Patent Application No. 2021-518529, 4 pages.

Japanese Office Action issued on Dec. 26, 2022, in Japanese Patent Application No. 2021-518529 (with English translation), 5 pages.

AEROSOL-GENERATING ARTICLE WITH HIGH AEROSOL FORMER CONTENT

The present invention relates to an aerosol-generating article and a method for producing an aerosol-generating article.

It is known to provide an aerosol-generating device for generating an inhalable aerosol. Such devices may heat aerosol-forming substrate contained in an aerosol-generating article without burning the aerosol-forming substrate. The aerosol-generating article may have an elongate shape for insertion of the aerosol-generating article into a heating chamber of the aerosol-generating device. A heating element may be arranged inside the heating chamber, for example a bin or a blade or around the heating chamber for heating the aerosol-forming substrate once the aerosol-generating article is inserted into the heating chamber of the aerosol-generating device.

While the temperature required by such a device to release relevant amounts of material to allow the formation of an acceptable aerosol is significantly lower than combustion, not all substrates are suitable to release sufficient amounts of material to form an adequate aerosol at a predetermined temperature, below combustion temperature the aerosol-forming substrate. Therefore, sophisticated but aerosol-forming substrates have been developed to allow the release of material at low temperatures. Today, this is achieved by converting the tobacco leaf into artificial homogenized tobacco sheets, for example using paper making or casting processes.

It would be desirable to provide aerosol-generating articles that have a simple construction and that allow aerosol generation at low temperatures. Also, it would be desirable to provide a so call "heat-not-burn" article that have a more natural appearance and taste.

According to a first aspect of the invention there is provided an aerosol-generating article comprising a substrate portion containing aerosol-forming substrate. The substrate portion has a length of between 20 millimeters and 60 millimeters and a diameter of between 4 millimeters millimeters and 7 millimeters millimeters. The aerosol-forming substrate comprises an aerosol former. The amount of aerosol former may range between 6 percent and 20 percent by weight on a dry weight basis of the aerosol-forming substrate. The aerosol-generating article may comprise a connect portion provided at one end of the aerosol-generating article in direct abutment with the substrate portion. The connect portion may have a tubular empty core structure.

According to an aspect of the invention there is provided an aerosol-generating article comprising a substrate portion containing aerosol-forming substrate. The substrate portion has a length of between 20 millimeters and 60 millimeters and a diameter of between 4 millimeters and 7 millimeters. The aerosol-forming substrate comprises an aerosol former. The amount of aerosol former ranges between 6 percent and 20 percent by weight on a dry weight basis of the aerosol-forming substrate. The aerosol-generating article comprises a connect portion with an external diameter between 5 mm and 6 mm, an internal diameter between 3.5 and 4.5 mm, and a length between 10 and 25 mm.

Preferably, the substrate portion has a diameter in the range of between 5 millimeters and 6 millimeters, more preferably, the substrate portion has a diameter of between 5.2 millimeters and 5.5 to millimeters, most preferably, about substrate portion has a diameter of 5.3 millimeters. The smaller the diameter of the substrate is, the lower is the temperature that is required to raise the core temperature of the aerosol-generating article such that sufficient amounts of material is release to form a desired amount of aerosol. At the same time, a small diameter allows for a fast penetration of the heat into the entire volume of aerosol-forming substrate. Nevertheless, where the diameter is too small, the volume to surface ratio of the aerosol-forming substrate becomes unattractive as the amount of available aerosol-forming substrate diminishes. According to the invention, the preferred range of diameter between 5 and 6 millimeters is particularly advantageous in terms of a balance between energy consumption and aerosol delivery.

Using an aerosol-generating article with reduced diameter is particularly advantageous in combination with external heating systems that are arranged around the periphery of the aerosol-generating article. When used with such external heating systems less thermal energy is required to achieve a sufficiently high temperature in the center of the aerosol-generating article. Thus, when operating at lower temperatures a desired target temperature in the center of the aerosol-generating article may be achieved within a desired time frame and energy consumption.

Preferably, the aerosol-forming substrate comprises cut-filler. In this document, "cut-filler" is used to refer to a blend of shredded plant material, in particular leaf lamina, processed stems and ribs, homogenized plant material, like for example made into sheet form using casting or papermaking processes. The cut filler may also comprise other after-cut, filler tobacco or casing. According to preferred embodiments of the invention, the cut-filler comprises at least 25 percent of plant leaf lamina, more preferably, at least 50 percent of plant leaf lamina, still more preferably at least 75 percent of plant leaf lamina and most preferably at least 90 percent of plant leaf lamina. Preferably, the plant material is one of tobacco, mint, tea and cloves, however, the invention is equally applicable to other plant material that has the ability to release substances upon the application of heat that can subsequently form an aerosol.

Preferably, the tobacco plant material comprises lamina of one or more of bright tobacco lamina, dark tobacco, aromatic tobacco and filler tobacco. Bright tobaccos are tobaccos with a generally large, light coloured leaves. Throughout the specification, the term "bright tobacco" is used for tobaccos that have been flue cured. Examples for bright tobaccos are Chinese Flue-Cured, Flue-Cured Brazil, US Flue-Cured such as Virginia tobacco, Indian Flue-Cured, Flue-Cured from Tanzania or other African Flue Cured. Bright tobacco is characterized by a high sugar to nitrogen ratio. From a sensorial perspective, bright tobacco is a tobacco type which, after curing, is associated with a spicy and lively sensation. According to the invention, bright tobaccos are tobaccos with a content of reducing sugars of between about 2.5 percent and about 20 percent of dry weight base of the leaf and a total ammonia content of less than about 0.12 percent of dry weight base of the leaf. Reducing sugars comprise for example glucose or fructose. Total ammonia comprises for example ammonia and ammonia salts. Dark tobaccos are tobaccos with a generally large, dark coloured leaves. Throughout the specification, the term "dark tobacco" is used for tobaccos that have been air cured. Additionally, dark tobaccos may be fermented. Tobaccos that are used mainly for chewing, snuff, cigar, and pipe blends are also included in this category. Typically, these dark tobaccos are air cured and possibly fermented. From a sensorial perspective, dark tobacco is a tobacco type which, after curing, is associated with a smoky, dark cigar type sensation. Dark tobacco is characterized by a low sugar to nitrogen ratio. Examples for dark tobacco are Burley Malawi or other African Burley, Dark Cured Brazil Galpao, Sun Cured or Air Cured Indonesian Kasturi. According to the invention, dark tobaccos are tobaccos with a content of reducing sugars of less than about 5 percent of dry weight base of the leaf and a total ammonia content of up to about 0.5 percent of dry weight base of the leaf. Aromatic tobaccos are tobaccos that often have small, light coloured leaves. Throughout the specification, the term "aromatic tobacco" is used for other tobaccos that have a high aromatic content, e.g. of essential oils. From a sensorial perspective, aromatic tobacco is a tobacco type which, after curing, is associated with spicy and aromatic sensation. Example for aromatic tobaccos are Greek Oriental, Oriental Turkey, semi-oriental tobacco but also Fire Cured, US Burley, such as Perique, Rustica, US Burley or Meriland. Filler tobacco is not a specific tobacco type, but it includes tobacco types which are mostly used to complement the other tobacco types used in the blend and do not bring a specific characteristic aroma direction to the final product. Examples for filler tobaccos are stems, midrib or stalks of other tobacco types. A specific example may be flue cured stems of Flue Cure Brazil lower stalk.

The cut-filler suitable to be used with the present invention generally may resemble to cut-filler used for conventional smoking articles. The cut width of the cut filler preferably is between 0.3 millimeters and 2.0 millimeters, more preferably, the cut width of the cut filler is between 0.5 millimeters and 1.2 millimeters and most preferably, the cut width of the cut filler is between 0.6 millimeters and 0.9 millimeters. The cut width may play a role in the distribution of heat inside the substrate portion of the article. Also, the cut width may play a role in the resistance to draw of the article. Further, the cut width may impact the overall density of the substrate portion.

The strand length of the cut-filler is to some extent a random value as the length of the strands will depend on the overall size of the object that the strand is cut off from. Nevertheless, by conditioning the material before cutting, for example by controlling the moisture content and the overall subtlety of the material, longer strands can be cut. Preferably, the strands have a length of between about 10 millimeters and about 40 millimeters before the strands are formed into the substrate section. Obviously, if the strands are arranged in a substrate section in a longitudinal extension where the longitudinal extension of the section is below 40 millimeters, the final substrate section may comprise strands that are on average shorter than the initial strand length. Preferably, the strand length of the cut-filler is such that between about 20 percent and 60 percent of the strands extend along the full length of the substrate portion. This prevents the strands from dislodging easily from the substrate section.

In preferred embodiments, the weight of the aerosol-forming substrate is between 80 milligrams and 400 milligrams, preferably between 150 milligrams and 250 milligrams, more preferably between 170 milligrams and 220 milligrams. This amount of aerosol forming typically allows for sufficient material for the formation of an aerosol. Additionally, in the light of the aforementioned constraints on diameter and size, this allows for a balanced density of the aerosol-forming substrate between energy uptake, resistance to draw and fluid passageways within the substrate section where the substrate comprises plant material.

According to the invention, the aerosol-forming substrate is soaked with aerosol former. Soaking the aerosol-forming substrate can be done by spraying or by other suitable application methods. The aerosol former may be applied to the blend during preparation of the cut-filler. For example, the aerosol former may be applied to the blend in the direct conditioning casing cylinder (DCCC). Conventional machinery can be used for applying an aerosol former to the cut-filler. The aerosol former may be any suitable known compound or mixture of compounds that, in use, facilitates formation of a dense and stable aerosol. The aerosol former may be facilitating that the aerosol is substantially resistant to thermal degradation at temperatures typically applied during use of the aerosol-generating article. Suitable aerosol formers are for example to: polyhydric alcohols such as, for example, triethylene glycol, 1,3-butanediol, propylene glycol and glycerine; esters of polyhydric alcohols such as, for example, glycerol mono-, di- or triacetate; aliphatic esters of mono-, di- or polycarboxylic acids such as, for example, dimethyl dodecanedioate and dimethyl tetradecanedioate; and combinations thereof.

Preferably, the aerosol former comprises one or more of glycerine and propylene glycol. The aerosol former may consist of glycerine or propylene glycol or of a combination of glycerine and propylene glycol.

Preferably, the amount of aerosol former is between 6 percent and 20 percent by weight on a dry weight basis of the aerosol-forming substrate, more preferably, the amount of aerosol former is between 8 percent and 18 percent by weight on a dry weight basis of the aerosol-forming substrate, most preferably the amount of aerosol former is between 10 percent and 15 percent by weight on a dry weight basis of the aerosol-forming substrate. For some embodiments the amount of aerosol former has a target value of about 13 percent by weight on a dry weight basis of the aerosol-forming substrate. The most efficient amount of aerosol former will depend also on the aerosol-forming substrate, whether the aerosol-forming substrate comprises plant lamina or homogenized plant material. For example, among other factors, the type of substrate will determine to which extent the aerosol-former can facilitate the release of substances from the aerosol-forming substrate.

For these reasons, the aerosol-forming substrate of the present invention is capable of efficiently generating sufficient amount of aerosol at relatively low temperatures. A temperature of between 150 degrees Celsius and 200 degrees Celsius in the heating chamber is sufficient for the aerosol-forming substrate of the present invention to generate sufficient amounts of aerosol while in aerosol-generating devices using tobacco cast leave sheets typically temperatures of about 250 degrees Celsius are employed.

A further advantage of the present invention connected with operating at lower temperatures is that it is not the requirement to cool down the aerosol is reduced. As generally low temperatures are used, a simpler cooling function may be sufficient. This in turn allows using a simpler and less complex structure of the aerosol-generating article.

Therefore, advantageously, the aerosol-generating article of the present invention comprises exclusively a substrate portion in which the aerosol-forming substrate is provided, without any additional segments or section. Such embodiment would have a particularly simple structure.

The aerosol-generating article may further comprise a connect portion provided at one end of the aerosol generating article in direct abutment with the substrate portion. Preferably, the connect portion may be located downstream from the substrate portion. As used herein, the terms 'upstream' and 'downstream' are used to describe the relative positions of components, or portions of components, of the aerosol-generating article according to the invention in relation to the direction of air drawn through the aerosol-generating article during use thereof.

The connect portion may have a tubular empty core structure. The connect portion may be for example a hollow acetate tube (HAT), a fine hollow acetate tube (FHAT) or a plug of tow wrapped around a central cardboard tube, all of which structures being known from manufacture of filter elements.

The connect portion may be provided as a hollow acetate tube having an inner diameter of between 3 millimeters and 5 millimeters, preferably between 3.5 millimeters and 4.5 millimeters, more preferably about 4 millimeters.

The connect portion may be provided as a fine hollow acetate tube having a wall thickness of between 0.4 millimeters and 0.9 millimeters, preferably between 0.5 millimeters and 0.7 millimeters, more preferably 0.6 millimeters.

Preferably, the length of the connect portion is between 5 millimeters to 30 millimeters, preferably, the length of the connect portion is between 10 millimeters to 25 millimeters.

If the aerosol-generating article is to be used in combination with a re-usable mouthpiece the, connect portion may be advantageously used in order to provide a firm and air-tight connection to such mouthpiece. The length of the connect portion may easily varied such that the overall length of the aerosol-generating article may readily be adopted as required by the aerosol-generating system in which the aerosol-generating article is to be used.

The aerosol-generating article may have an overall length of between 20 millimeters and 60 millimeters, preferably of between 40 millimeters and 50 millimeters and more preferably about 45 millimeters.

The aerosol-generating article may further comprise a tipping paper arranged at least partly wrapped around the connect portion and the substrate portion to overlap the connect portion and the substrate portion. The tipping paper may have a length of 10 millimeters to 30 millimeters. The tipping paper may be used to attach the components of the aerosol-generating article to each other.

Preferably the aerosol-generating article comprises only the two sections, namely a substrate portion and a connect portion. Such embodiment would still have a very simple structure and could therefore be produced at significantly reduced cost.

If desired or required, for example to achieve a sufficiently high resistance to draw of the aerosol-generating article, an additional filter section may be included in the aerosol-generating article. Preferably such additional filter section may be included between the substrate portion and the connect portion. Preferably, such additional filter section comprises a filtration material such as, for example, cellulose acetate. Preferably, such additional filter section comprises a filtration material such as, for example, cellulose acetate. Preferably, the length of the additional filter section is between about 4 millimeters and about 8 millimeters, preferably, between about 5 millimeters and about 7 millimeters. Preferably, the combined length of the additional filter section and the connect portion is between about 10 millimeters and about 18 millimeters, preferably, 13 millimeters.

The aerosol-generating article may further comprise means for preventing inadvertent or intentional combustion of the aerosol-forming substrate. Such means may include a wrapper of incombustible material such as a metallic foil or a co-laminated paper such as an aluminum co-laminated paper. The aerosol-forming substrate of the present device is not intended and not suitable for being smoked in a conventional way by burning one end with a lighter. The use of an additional incombustible wrapper may efficiently increase the safety of use of the aerosol-generating article.

A dense end region of aerosol-forming substrate may be provided at one or more of the upstream end and downstream end of the substrate portion of the aerosol-generating article. A dense end region may have a density that is up to 10 percent higher than the density of the remaining section of the substrate portion. Increasing the substrate density at the extremities of the substrate portion may help to prevent tobacco from falling out of the ends of the substrate portion. An increased substrate density on the downstream end of the substrate portion may further help to ensure good and solid attachment of the substrate portion to the connect portion or any other component attached to the downstream end of the substrate portion. The increased density at the extremities of the substrate portion may be obtained by providing an increased amount of cut-filler at the ends of the substrate portion. Additionally, the dense ends may improve the release of material from the aerosol-forming substrate. In preferred embodiments, the application of thermal energy is limited to the aerosol-forming substrate to prevent that adjacent sections of the aerosol-generating article are exposed to heat. For example, excessive heat may deteriorate other section of the article as for example the aforementioned element. Additionally, as for the formation of the aerosol droplets the material needs to condense, extended application of heat along the downstream end of the aerosol-forming substrate is detrimental to the aerosol formation. Therefore, in such a case, the ends of the aerosol-forming substrate may receive less heat then the central part of the aerosol-forming substrate. An increase of the density, that is, an increase of the presence of material in this area may allow this end part of the aerosol-forming section to efficiently contribute to the release of material in such an uneven heating arrangement, The downstream end of the connect portion of the aerosol-generating article may further be configured to be connected to a mouthpiece. The mouthpiece may be a reusable mouthpiece and may also be provided with a connect portion. In use the connect portion of the aerosol-generating article is connected to the connect portion of the mouthpiece. In one embodiment the mouthpiece may define an internal channel for allowing the inhalable aerosol to pass there through. The internal channel of the mouthpiece may have an internal diameter that varies along the longitudinal length of the mouthpiece.

The internal diameter of the internal channel of the mouthpiece may progressively increase towards the downstream end of the mouthpiece. An air channel with increasing diameter may suitably act as a cooling element. The inhalable aerosol drawn through such channel expands and therefore cools down according to the so-called Venturi effect.

In a further aspect of the invention there is provided an aerosol generating device comprising a housing, a control circuitry and a power source. The housing defines a heating chamber within which a heating element is arranged. The heating chamber is configured to define a cavity for receiving an aerosol-generating article comprising aerosol-forming substrate. The aerosol-generating article can be inserted into the heating chamber and heated by the heating element.

The heating element is configured to heat the aerosol-forming substrate to generate an aerosol. The control circuit is configured to maintain the temperature of the heating element at a target temperature during use, or alternatively, maintain the temperature of the heating element at a predetermined target temperature profile.

The heating element may be configured as an external heating element. An external heating element may take any suitable form. For example, an external heating element may take the form of one or more flexible heating foils on a dielectric substrate, such as polyimide. The flexible heating foils can be shaped to conform to the perimeter of the substrate receiving cavity. Alternatively, an external heating element may take the form of a metallic grid or grids, a flexible printed circuit board, a molded interconnect device (MID), ceramic heater, flexible carbon fiber heater or may be formed using a coating technique, such as plasma vapor deposition, on a suitable shaped substrate. An external heating element may also be formed using a metal having a defined relationship between temperature and resistivity. In such an exemplary device, the metal may be formed as a track between two layers of suitable insulating materials. An external heating element formed in this manner may be used to both heat and monitor the temperature of the external heating element during operation. Alternatively, or in addition, an internal heating element may be provided, for example a pin or a blade that is inserted for use at least partly into the aerosol-forming substrate.

The aerosol generating device may further comprise a mouthpiece that in use is to be connected to the aerosol-generating article. The mouthpiece may be a separate part or may be a part of the aerosol generating device. For example the mouthpiece may be hingedly connected to the housing of the aerosol generating device.

The mouthpiece may help to center the aerosol-generating article inside the heating chamber. By centering the aerosol-generating article in the heating chamber a homogenized heat transfer to the aerosol-generating article may be obtained. This may further reduce the required maximum temperature in order to obtain maximum aerosol generation efficiency and may help increasing the user experience consistency. In a further aspect of the invention there is provided an aerosol-generating system, comprising an aerosol generating device comprising a heating element, and an aerosol generating article as described above.

The aerosol-generating system is preferably configured such that the aerosol-forming substrate of the aerosol-generating article in use is heated to temperatures of between 150 degrees Celsius and 250 degrees Celsius, preferably to temperatures of between 170 degrees Celsius and 220 degrees Celsius and more preferably to temperatures of between 180 degrees Celsius and 200 degrees Celsius.

In a further aspect of the invention there is provided an aerosol-generating system comprising an aerosol-generating article as described above, an aerosol-generating device, wherein the aerosol-generating device comprises a heating chamber and an external heating member arranged outside the heating chamber, or, an internal heating member arranged inside the heating chamber, or both an external heating member and an internal heating member, a control unit to control the temperature profile of the heating member and a power supply to power the heating member. The control unit may control the temperature profile of the heating member to heat the aerosol-forming substrate of the aerosol-generating article to a temperature of between 150° C. and 200° C. in the heating chamber The invention further relates to a method for manufacturing an aerosol-generating article, wherein the method comprises the following steps:

i. providing aerosol-forming substrate, ii. applying an aerosol former to the aerosol-forming substrate, wherein the amount of aerosol former ranges between 6 percent and 20 percent by weight on a dry weight basis of the aerosol-forming substrate, and iii. shaping the aerosol-forming substrate as a substrate portion, wherein the substrate portion has a length of between 20 millimeters and 45 millimeters and a diameter of between 4 millimeters and 7 millimeters.

According to this aspect of the invention, the substrate portion according to the method preferably has a diameter that is in a range of between 5 millimeters and 6 millimeters, more preferably between 5.2 millimeters and 5.5 millimeters. The substrate portion may have a diameter that amounts to about 5.3 millimeters. The smaller the diameter of the substrate the lower is the temperature that is required to raise the core temperature of the aerosol-generating article such that sufficient amounts of material is released to form a desired amount of aerosol.

The aerosol-forming substrate may comprise cut-filler. The cut-filler suitable to be used with the present invention generally may correspond to cut-filler used for conventional smoking articles. The cut width of the cut filler may range between 0.3 millimeters and 2.0 millimeters, between 0.5 millimeters and 1.2 millimeters and between 0.6 millimeters and 0.9 millimeters.

The strand length of the cut-filler can be freely chosen as considered suitable. The strand length of the cut-filler may be such that 20% to 60% of the strands extend along the full length of the substrate portion.

The weight of the aerosol-forming substrate may be between 80 milligrams and 400 milligrams, preferably between 200 milligrams and 300 milligrams, more preferably between 245 milligrams and 270 milligrams.

The method may further comprise a step of impregnating the cut-filler with the aerosol former. Impregnation can be done by spraying or by other suitable application methods. The aerosol former may be applied to the blend during preparation of the cut-filler. For example, the aerosol former may be applied to the blend in the direct conditioning casing cylinder (DCCC). Conventional machinery can be used for applying an aerosol former to the cut-filler. The aerosol former may be any suitable known compound or mixture of compounds that, in use, facilitates formation of a dense and stable aerosol and that is substantially resistant to thermal degradation at temperatures typically applied during use of the aerosol-generating article. Suitable aerosol formers are well known in the art and include, but are not limited to: polyhydric alcohols such as, for example, triethylene glycol, 1,3-butanediol, propylene glycol and glycerine; esters of polyhydric alcohols such as, for example, glycerol mono-, di- or triacetate; aliphatic esters of mono-, di- or polycarboxylic acids such as, for example, dimethyl dodecanedioate and dimethyl tetradecanedioate; and combinations thereof.

The aerosol former may comprise one or more of glycerine and propylene glycol. The aerosol former may consist of glycerine or propylene glycol or of a combination of glycerine and propylene glycol.

The amount of aerosol former may range between 6 percent and 20 percent by weight on a dry weight basis of the aerosol-forming substrate.

The aerosol-generating article of the present invention may comprise essentially only a substrate portion in which the aerosol-forming substrate is provided. Such embodiment would have the simplest possible structure.

The method may further comprise the steps of providing a connect portion that may be attached at one end of the aerosol generating article in direct abutment with the substrate portion. The connect portion may be located downstream from the substrate portion.

The connect portion may have a tubular empty core structure. The connect portion may be a hollow acetate tube (HAT), a fine hollow acetate tube (FHAT) or a plug of tow wrapped around a central cardboard tube, all of which structures being known from manufacture of filter elements used in e-smoking devices. The connect portion may be formed from any suitable material or combination of materials. For example, the filter portion may be formed from one or more materials selected from the group consisting of: cellulose acetate; cardboard; paper, such as crimped heat resistant paper or crimped parchment paper; cotton; viscose; glass fibres; and other polymeric materials, such as low density polyethylene (LDPE). In a preferred embodiment, the filter portion is formed from cellulose acetate.

The connect portion may be provided as a hollow acetate tube having an inner diameter of between 3 millimeters and 5 millimeters, preferably between 3.5 millimeters and 4.5 millimeters, more preferably about 4 millimeters.

The connect portion may be provided as a fine hollow acetate tube having a wall thickness of between 0.4 millimeters and 0.9 millimeters, preferably between 0.5 millimeters and 0.7 millimeters, more preferably 0.6 millimeters. The length of the connect portion may range between 5 millimeters to 30 millimeters, preferably, the length of the connect portion is between 10 millimeters to 25 millimeters.

The aerosol-generating article may have an overall length of between 20 millimeters and 60 millimeters, preferably of between 40 millimeters and 50 millimeters and more preferably about 45 millimeters.

The method may further comprise the step of providing a tipping paper arranged at least partly wrapped around the connect portion and the substrate portion to overlap the connect portion and the substrate portion. The tipping paper may have a length of 10 millimeters to 30 millimeters. The tipping paper may be used to attach the components of the aerosol-generating article to each other.

Preferably the aerosol-generating article comprises only the two sections, namely a substrate portion and a connect portion. Such embodiment would still have a very simple structure and could therefore be produced at significantly reduced cost.

The method may further comprise the step of providing a filter section to be included in the aerosol-generating article. Preferably such additional filter section may be included between the substrate portion and the connect portion.

The method may further comprise the step of providing means for preventing inadvertent or intentional combustion of the aerosol-forming substrate. Such means may include a wrapper of incombustible material such as a metallic foil or a co-laminated paper such as an aluminum co-laminated paper.

The method may further comprise the step of providing a dense end region of aerosol-forming substrate at one or more of the upstream end and downstream end of the substrate portion of the aerosol-generating article. A dense end region may have a density that is up to 10 percent higher than the density of the remaining section of the substrate portion.

The downstream end of the connect portion of the aerosol-generating article may further be configured to be connected to a mouthpiece. The mouthpiece may be a reusable mouthpiece and may also be provided with a connect portion. In use the connect portion of the aerosol-generating article is connected to the connect portion of the mouthpiece. In one embodiment the mouthpiece may define an internal channel for allowing the inhalable aerosol to pass there through. The internal channel of the mouthpiece may have an internal diameter that varies along the longitudinal length of the mouthpiece.

The internal diameter of the internal channel of the mouthpiece may progressively increase towards the downstream end of the mouthpiece. An air channel with increasing diameter may suitably act as a cooling element. The inhalable aerosol drawn through such channel expands and therefore cools down according to the so-called Venturi effect.

Features described in relation to one aspect may equally be applied to other aspects of the invention.

Figure 2:
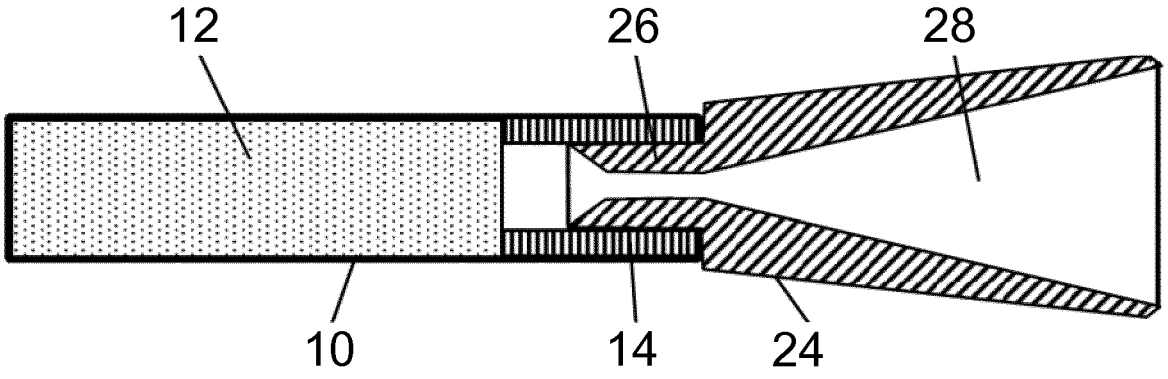
Figure 3:
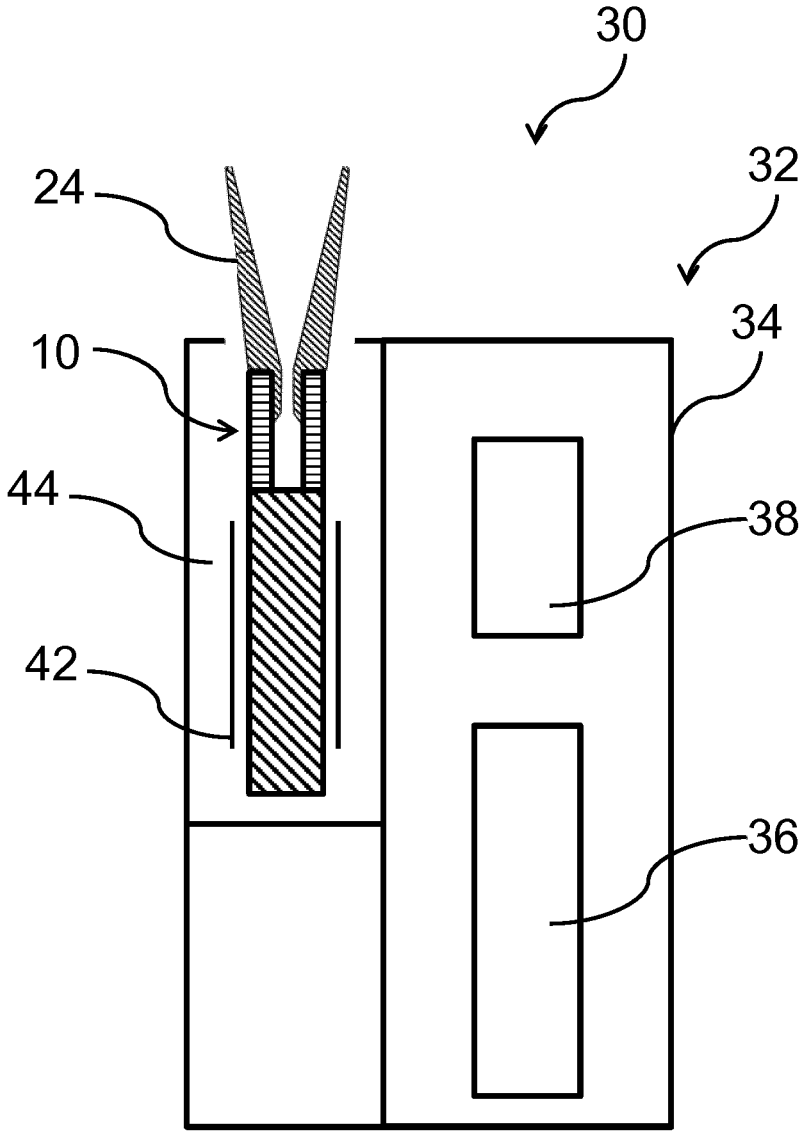

The invention will be further described, by way of example only, with reference to the accompanying drawings in which:

FIG. 1 shows a side view of an aerosol-generating article according to the present invention, FIG. 2 shows a cross-section through an aerosol-generating article including a mouthpiece, and FIG. 3 shows a cross-section through an aerosol-generating system of the present invention.

In FIG. 1 an aerosol-generating article 10 according to the present invention is depicted. The aerosol-generating article 10 comprises a substrate portion 12 and a connect portion 14 in the form of a hollow acetate tube. The hollow acetate tube is in direct abutment with the substrate portion 12. These two portions are connected together by a tipping paper 16 that extends over the complete connect portion 14 and a part of the substrate portion 12.

The substrate portion 12 has a length of 32 millimeters, and a diameter of 5.3 millimeters. The connect portion 14 has a length of 15 millimeters and also an external diameter of 5.3 millimeters. The internal diameter of the hollow acetate tube of the connect portion 14 amounts to 4 millimeters.

The tipping paper 16 has a length of 20 millimeters. The two-part aerosol-generating article 10 has an overall length of 45 millimeters. In order to prevent loose ends, the aerosol-forming substrate is provided with an increased substrate density at both ends of the substrate portion 12. The dense end 20 at the upstream end of the aerosol-generating article 10 prevents aerosol-forming substrate from falling out of the upstream end portion of the substrate portion 12. The dense end 22 at the downstream end of the substrate portion 12, provides this part of the substrate portion 12 with sufficient rigidity which helps to ensure good and solid attachment of the substrate portion 12 to the connect portion 14.

The connect portion 14 is configured to be connected in use of the aerosol-generating article 10 to a mouth piece 24 as can be seen in the cross-sectional view depicted in FIG. 2. Again the aerosol-generating article 10 comprises two portions, a substrate portion 12 and a connect portion 14 that are firmly attached with each other. The mouth piece 24 also comprises a connect portion 26 which is has an outer diameter that corresponds to the inner diameter of the connect portion of 14 of the aerosol-generating article 10. When attached together an air tight connection between the mouth piece 24 and the aerosol-generating article 10 is established.

The mouthpiece 24 has a central channel 28 that defines an air flow path for the generated aerosol. The diameter of the central channel 28 is progressively increasing along the air flow path. Due to the Venturi effect caused by this construction the mouthpiece 24 efficiently supports cooling of the aerosol.

In FIG. 3 a schematic cross-section of an aerosol-generating system 30 of the present invention is depicted. The aerosol generating system 30 comprises an aerosol-generating device 32 and an aerosol-generating article 10.

The aerosol-generating device 32 comprises a housing 34 in which a power source 36 and electronic circuitry 38 is located. The aerosol-generating device 32 further comprises a heating chamber 40 in which a heating element 42 is arranged.

As depicted in FIG. 3, the heating chamber 40 defines a cavity that is configured to receive the aerosol-generating article 10. When inserted into the heating chamber 40 the heating element 42 circumscribes the outer periphery of the aerosol-generating article 10. In the embodiment of FIG. 3 the heating element 42 is provided as an external heating element.

The invention claimed is:

1. An aerosol-generating article, comprising:
only two portions: a substrate portion and a connect portion,
the substrate portion containing an aerosol-forming substrate and
the connect portion being disposed at one end of the aerosol-generating article in direct abutment with the substrate portion, the connect portion having a tubular empty core structure,
wherein the substrate portion has a length of between 20 millimeters and 60 millimeters, and a diameter of between 4 millimeters and 7 millimeters,
wherein the aerosol-forming substrate comprises an aerosol former, and
wherein an amount of the aerosol former ranges between 6 percent and 20 percent by weight on a dry weight basis of the aerosol-forming substrate.

2. An aerosol-generating article, comprising:
a substrate portion containing an aerosol-forming substrate; and
a connect portion,
wherein the substrate portion has a length of between 20 millimeters and 60 millimeters, and a diameter of between 5 millimeters and 6 millimeters,
wherein the aerosol-forming substrate comprises an aerosol former,
wherein an amount of aerosol former ranges between 6 percent and 20 percent by weight on a dry weight basis of the aerosol-forming substrate, and
wherein the connect portion has an external diameter between 5 millimeters and 6 millimeters, an internal diameter between 3.5 millimeters and 4.5 millimeters, and a length between 10 millimeters and 25 millimeters.

3. The aerosol-generating article according to claim 1, wherein the amount of aerosol former ranges between 8 percent and 15 percent by weight on a dry weight basis of the aerosol-forming substrate.

4. The aerosol-generating article according to claim 1, wherein the aerosol-generating article has a length of between 30 millimeters and 60 millimeters.

5. The aerosol-generating article according to claim 1, wherein the substrate portion has a diameter of between 5 millimeters and 6 millimeters.

6. The aerosol-generating article according to claim 1, wherein the aerosol-generating article further comprises a hollow acetate tube as the connect portion, downstream of the substrate portion.

7. The aerosol-generating article according to claim 1, wherein the connect portion has a length of between 10 millimeters and 25 millimeters.

8. The aerosol-generating article according to claim 6,
wherein the aerosol-generating article further comprises a tipping paper arranged at least partly wrapped around the connect portion and the substrate portion to overlap the connect portion and the substrate portion, and
wherein the tipping paper has a length of 15 millimeters to 30 millimeters.

9. The aerosol-generating article according to claim 6, wherein the connect portion is provided as a hollow acetate tube having an inner diameter of between 3 millimeters and 5 millimeters.

10. The aerosol-generating article according to claim 1, wherein the connect portion is provided as a hollow acetate tube having a wall thickness of between 0.4 millimeters and 0.8 millimeters.

11. The aerosol-generating article according to claim 1, wherein the aerosol-forming substrate is cut-filler, comprising strips of plant material.

12. The aerosol-generating article according to claim 1, wherein the cut-filler is at least 25 percent per weight of plant leaf lamina.

13. The aerosol-generating article according to claim 1, wherein a weight of the aerosol-forming substrate is between 80 milligrams and 400 milligrams.

14. The aerosol-generating article according to claim 1, wherein the aerosol former consists of glycerine, or propylene glycol, or any mixture thereof.

15. The aerosol-generating article according to claim 1, wherein a dense region of aerosol-forming substrate is provided at one of more of an upstream end and a downstream end of the substrate portion.

16. The aerosol-generating article according to claim 1,
wherein the aerosol-generating article has a length of between 30 millimeters and 60 millimeters, and
wherein the substrate portion is directly attached to the connect portion.

17. An aerosol-generating system, comprising:
an aerosol-generating article according claim 1; and
an aerosol-generating device,
wherein the aerosol-generating device comprises
a heating chamber,
an external heating member arranged outside the heating chamber, or, an internal heating member arranged inside the heating chamber, or both an external heating member and an internal heating member,
a controller configured to
control a temperature profile of the external heating member, or of the internal heating member, or of both the external heating member and the internal heating member, and
heat the aerosol-forming substrate of the aerosol-generating article to a temperature of between 150° C. and 200° C. in the heating chamber, and
a power supply configured to power the external heating member, or the internal heating member, or both the external heating member and the internal heating member.

18. A method for manufacturing an aerosol-generating article according to claim 1, the method comprising the following steps:
providing an aerosol-forming substrate;
applying an aerosol former to the aerosol-forming substrate, wherein an amount of aerosol former ranges between 6 percent and 20 percent by weight on a dry weight basis of the aerosol-forming substrate; and shaping the aerosol-forming substrate as a substrate portion, wherein the substrate portion has a length of between 20 millimeters and 60 millimeters, and a diameter of between 4 millimeters and 7 millimeters.

* * * * *